US009714536B2

(12) United States Patent
Timko et al.

(10) Patent No.: US 9,714,536 B2
(45) Date of Patent: Jul. 25, 2017

(54) DOOR FRAMES WITH ENERGY ABSORBING DOOR STOPS

(71) Applicant: Fry Reglet Corporation, Santa Fe Springs, CA (US)

(72) Inventors: William J. Timko, Suwanee, GA (US); Mark E. Brinkman, Cumming, GA (US)

(73) Assignee: FRY REGLET CORPORATION, Santa Fe Springs, CA (US)

( * ) Notice: Subject to any disclaimer, the term of this patent is extended or adjusted under 35 U.S.C. 154(b) by 0 days.

(21) Appl. No.: 14/875,304

(22) Filed: Oct. 5, 2015

(65) Prior Publication Data

US 2016/0097226 A1 Apr. 7, 2016

Related U.S. Application Data

(60) Provisional application No. 62/059,348, filed on Oct. 3, 2014.

(51) Int. Cl.

| | |
|---|---|
| ***E06B 1/52*** | (2006.01) |
| ***E06B 7/18*** | (2006.01) |
| ***E06B 1/04*** | (2006.01) |
| ***E05F 5/06*** | (2006.01) |
| *E06B 1/62* | (2006.01) |

(52) U.S. Cl.

CPC ..... *E06B 1/52* (2013.01); *E05F 5/06* (2013.01); *E06B 1/045* (2013.01); *E06B 1/526* (2013.01); *E06B 7/18* (2013.01); *E06B 2001/622* (2013.01)

(58) Field of Classification Search

CPC . E06B 1/526; E06B 1/045; E06B 1/04; E05C 17/025

USPC ..... 49/489.1; 52/211

See application file for complete search history.

(56) References Cited

U.S. PATENT DOCUMENTS

| | | | | |
|---|---|---|---|---|
| 3,141,204 | A * | 7/1964 | Wheeler | E06B 3/02 49/383 |
| 3,287,856 | A * | 11/1966 | Passovoy | E06B 1/18 49/381 |
| 3,469,350 | A * | 9/1969 | Lange | E06B 1/045 49/504 |
| 3,774,345 | A * | 11/1973 | Cole | E05D 5/0223 16/235 |
| 4,223,494 | A * | 9/1980 | Wendt | E06B 1/52 49/504 |
| 4,369,600 | A * | 1/1983 | Passovoy | E06B 1/526 49/504 |

(Continued)

*Primary Examiner* — Katherine Mitchell
*Assistant Examiner* — Marcus Menezes
(74) *Attorney, Agent, or Firm* — Kilpatrick Townsend & Stockton LLP

(57) ABSTRACT

Described are trimless door frames and energy absorbing door stops. The energy absorbing door stop allows for relative movement between the door stop and the surrounding door frame. The relative movement of the energy absorbing door stop helps to distribute and dissipate forces and vibrations from opening and closing a door, reducing the levels of force transferred into the surrounding wall. The reduction in forces applied to the wall allows for the elimination of heavy door framing and trim. Since door trim is no longer necessary, trimless door frames may be installed with a smooth appearance without cracks appearing in the surrounding wall due to stress or fatigue.

19 Claims, 12 Drawing Sheets

(56) References Cited

U.S. PATENT DOCUMENTS

| | | | | | |
|---|---|---|---|---|---|
| 4,376,354 | A * | 3/1983 | Passovoy | E05D 5/0238 | 49/504 |
| 5,154,019 | A * | 10/1992 | Day | E05D 5/023 | 49/504 |
| 5,293,723 | A * | 3/1994 | Slessor | E06B 1/30 | 49/380 |
| 5,581,946 | A * | 12/1996 | Lin | E05C 19/001 | 49/368 |
| 6,282,851 | B1 * | 9/2001 | Beaton | E06B 1/12 | 49/505 |
| 6,526,694 | B1 * | 3/2003 | Cosgrove | E05B 65/06 | 49/163 |
| 8,713,866 | B2 * | 5/2014 | Gadoury | E06B 1/045 | 52/211 |
| 2014/0069038 | A1 * | 3/2014 | Back | E06B 1/52 | 52/210 |

* cited by examiner

DOOR FRAMES WITH ENERGY ABSORBING DOOR STOPS

CROSS REFERENCE TO RELATED APPLICATIONS

This application claims the benefit of U.S. Provisional Application Ser. No. 62/059,348 ("the '348 application"), filed on Oct. 3, 2014 and entitled "Trimless Door Frame." The '348 application is hereby incorporated in its entirety by this reference.

FIELD OF THE INVENTION

Embodiments of the invention relate to door frames having energy absorbing door stops.

BACKGROUND

Door openings are generally surrounded about their perimeters or "trimmed" with heavy framing to absorb the forces and vibrations associated with repeatedly opening and closing a door mounted within a door opening. Heavy framing is necessary to withstand the day-to-day usage of a door without producing cracks in the surrounding wall due to stress or fatigue. However, door frames are visible and can prevent construction of doors with a smooth, modern appearance with no visible framing.

SUMMARY

Aspects of the present disclosure relate to door frames that incorporate an energy absorbing door stop to distribute the forces and vibrations associated with opening and closing a door. The energy absorbing door stop helps to absorb and distribute the forces so that lower levels of force are transferred into the surrounding wall and thus obviates the need for a traditional door frame or trim. Decreased levels of force applied to the surrounding wall reduces the likelihood of cracking the surrounding wall due to stress or fatigue over many opening or closing cycles of the door.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

The described embodiments of the invention provide a trimless door frame assembly with an energy absorbing door stop. While the energy absorbing door stops are discussed for use with trimless door frames, they are by no means so limited. Rather, embodiments of the energy absorbing door stop may be used in any door including, but not limited to, fully framed or trimmed doors.

Figure 1:
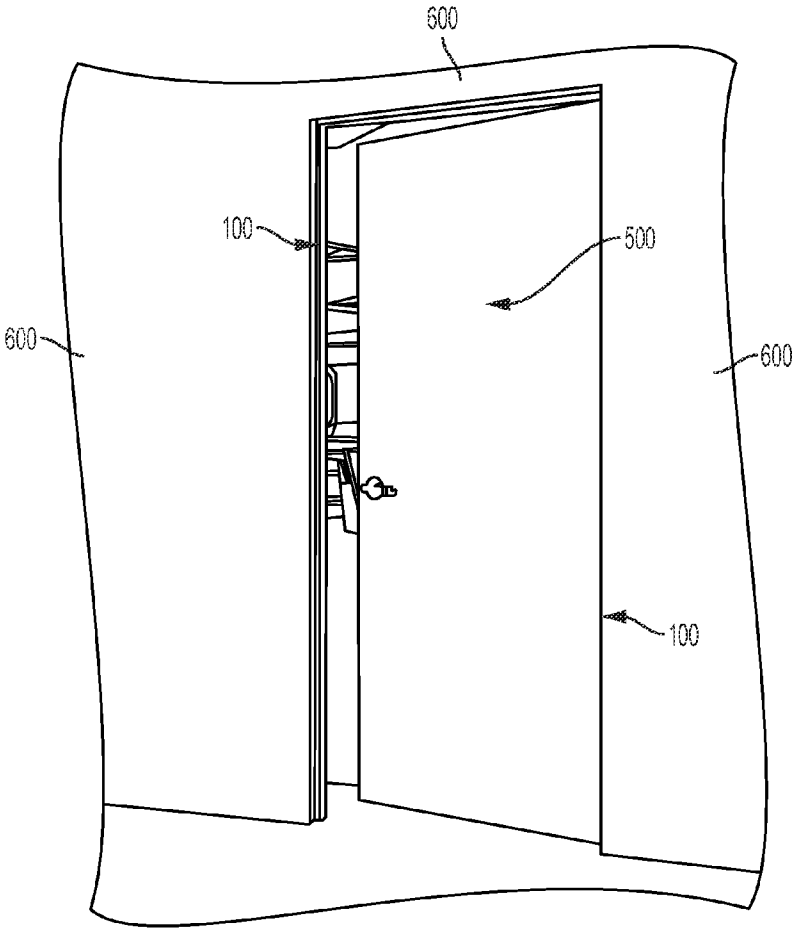
FIG. 1 is a perspective view of a trimless door frame installed in a wall according to certain embodiments of the present invention.

With reference to FIG. 1, embodiments of the invention relate to a trimless door frame assembly 100. The illustrated door frame is "trimless" in that it does not include the traditional exposed trim on the wall around the door opening that visibly frames the door positioned within the opening. As described in more detail below, the trimless door frame assembly 100 includes a door stop that absorbs shock and/or vibration from the door 500 opening and closing, which may prevent or reduce the amount of shock transferred to adjacent wall 600 (which may be constructed of drywall or any other suitable building materials). The trimless door frame assembly 100 may thus be installed around the perimeter of the door opening within or adjacent the wall 600 without the need for exposed trim on the wall 600 surrounding the door 500.

Figure 3:
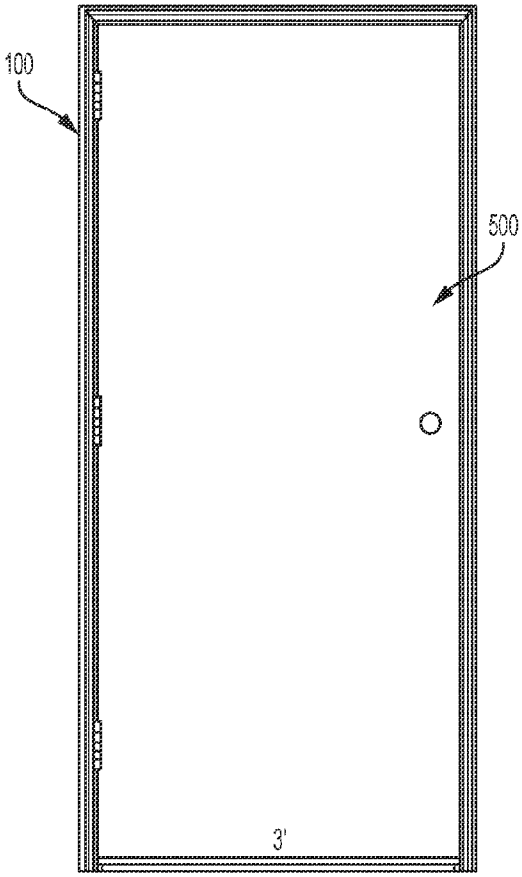
FIG. 3 is a front elevation view of the trimless door frame of FIG. 2.
Figure 2:
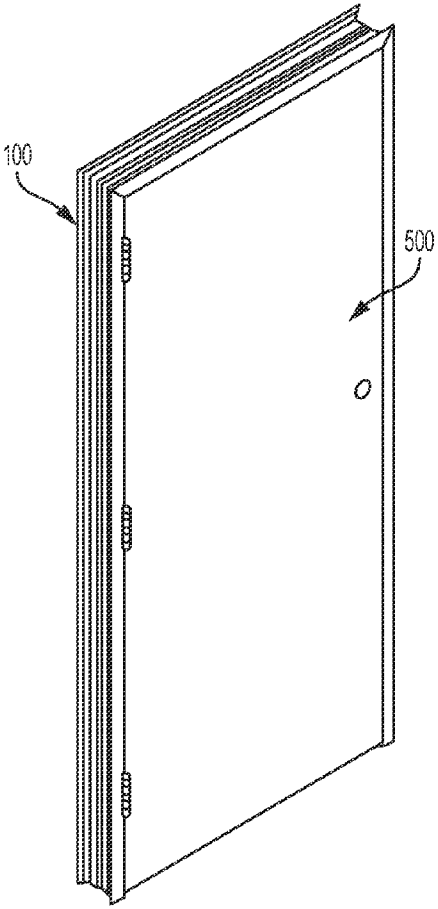
FIG. 2 is a perspective view a trimless door frame in isolation.

FIGS. 2 and 3 are perspective and elevation views of a trimless door frame assembly 100 with a door 500 installed within it. As shown, the trimless door frame assembly 100 may be constructed such that the door 500 may be substantially flush with one side of the trimless door frame assembly 100, and, consequently, the door 500 may be substantially flush with the wall or drywall when the trimless door frame assembly 100 is installed adjacent to the wall or drywall. In some embodiments, the trimless door frame assembly 100 may be used in conjunction with a door closer. The trimless door frame assembly 100 is compatible with both surface mounted and concealed door closing mechanisms.

FIGS. 4-7 are schematic end views of constituent components of a trimless door frame assembly 100 that, with other optional components, may be combined to form a trimless door frame assembly 100. One embodiment of a trimless door frame assembly 100 includes a door frame 150 (formed of a top frame side 150*a*, a hinge frame side 150*b*, and a strike plate frame side 150*c*), flush mount plate 200, floating door stop 250, and support plate 300, among other hardware or parts.

The door frame 150, flush mount plate 200, floating door stop 250, and support plate 300 may be individual components that are assembled together as described below. In some embodiments, the door frame 150, flush mount plate 200, floating door stop 250, and/or support plate 300 may be combined and/or formed from a single piece of material. Any of the below described parts may be constructed from metals, such as aluminum, steel, or other alloys, polymers, composites, or any other material selected for its ease of manufacturing, cost, durability in use, and resistance to corrosion or other environmental conditions. Furthermore, the parts may be produced by machining, casting, stamping, extrusion, any other applicable forming method, or any combination thereof.

Figure 16:
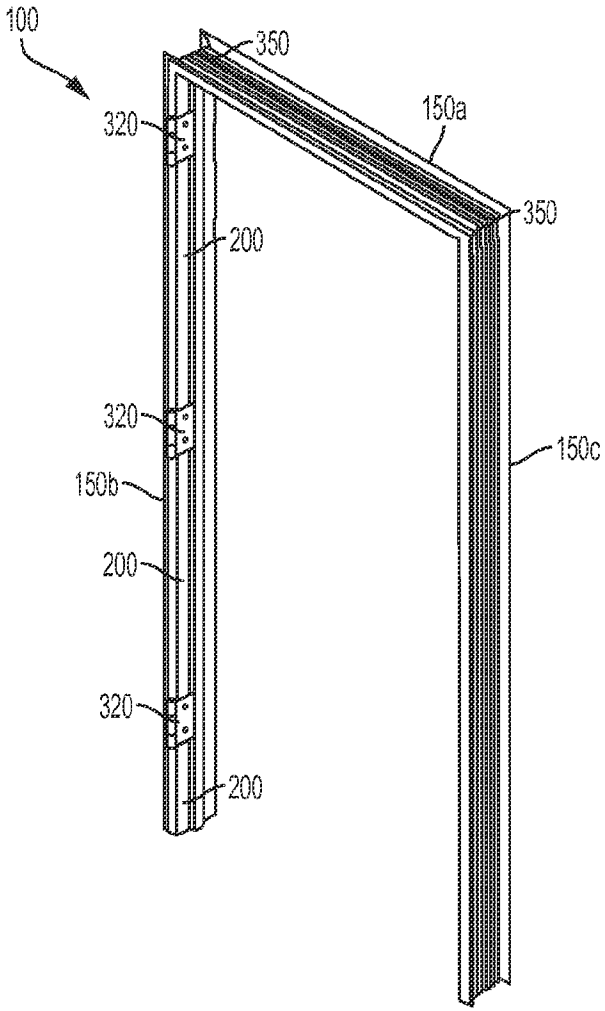
FIG. 16 is a perspective view of an assembled trimless door frame.

FIG. 16 is a perspective view of an exemplary door frame 150 formed by a top frame side 150*a*, a hinge frame side 150*b*, and a strike plate frame side 150*c*. In use, the door frame 150 is positioned around the perimeter of a door opening provided in a wall 600.

Figure 4:
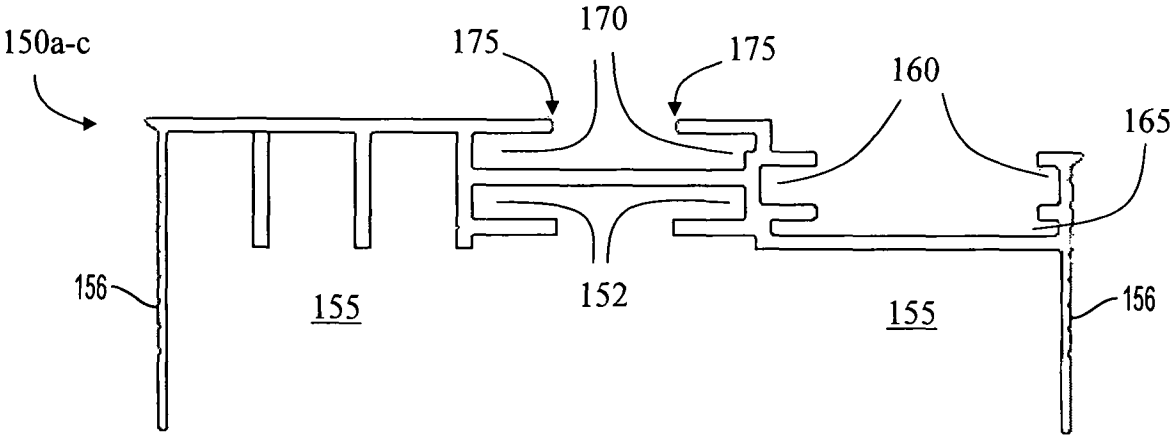
FIG. 4 is schematic end view of a trimless door frame.

The frames sides 150*a-c* of door frame 150 may have different cross-sectional profiles tailored to their position within the door frame 150. However, in other embodiments, the frame sides 150*a-c* have the identical profile, an example of which is shown in FIG. 4. In such embodiments, a single frame member bearing the profile may be formed and then cut to the desired length to serve as the top frame side 150*a*, hinge frame side 150*b*, and/or strike plate frame side 150*c*. The door frame 150 may have a rear side 155 that is adjacent the wall or drywall 600 when the trimless door frame assembly 100 is installed and flanges 156 that wrap around or about the wall or drywall 600. The door frame 150 may also include a hardware recess 160 with associated clearance gap 165, an assembly recess 152, and a door stop recess 170 with associated projections 175. The various recesses and features of the door frame 150 are configured to accept or receive the flush mount plate 200, floating door stop 250, support plate 300, and any additional parts or hardware as described below.

Figure 5:
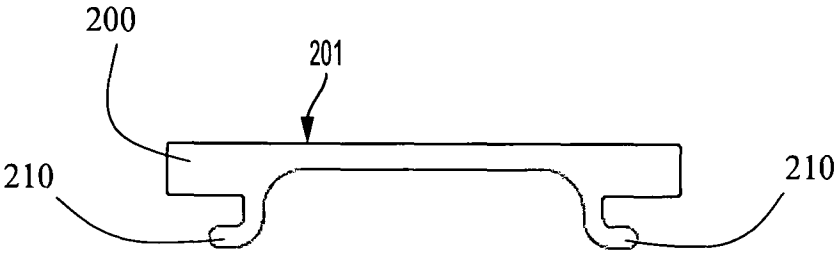
FIG. 5 is a schematic end view of a flush mount plate.

FIG. 5 is a schematic end view of a flush mount plate 200 with arms 210. The arms 210 of the flush mount plate 200 are configured to mate with the hardware recess 160 of the frame sides 150*a-c* so that the face surface 201 of the flush mount plate provides a level surface with other components or hardware that are installed in or near the hardware recess 160. In certain embodiments, the flush mount plate 200 may be used as a spacer or stacking component in the construction of a trimless door frame assembly 100, as described in more detail below.

Figure 6:
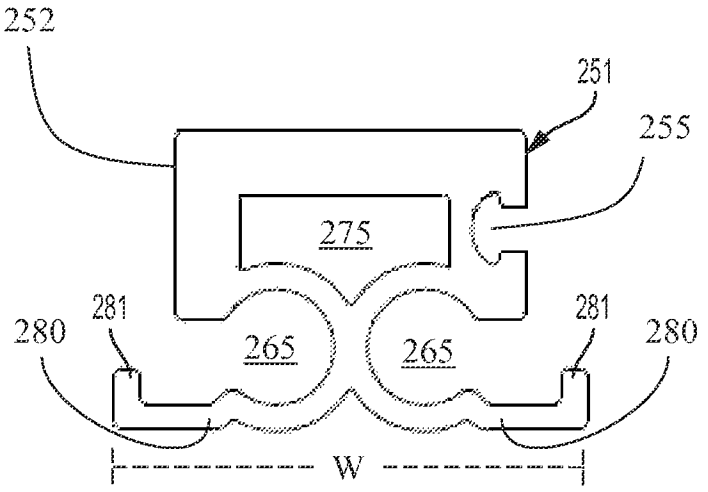
FIG. 6 is a schematic end view of a door stop frame.

FIG. 6 is a schematic end view of the door stop frame 252 of a floating door stop 250, which may include a silencer recess 255 configured to receive a door silencer 260 (shown in FIGS. 8-12, 14, and 15), an optional hollow 275 for lightness, reduction in material usage, and/or ease of manufacturing, one or more absorber recesses 265 configured to receive absorbers 270 (shown in FIGS. 8-12, 14, and 15), and one or more locator arms 280 with optional extensions 281. The door stop frame 252 may also include a strike face 251 as the region of contact between a door and the floating door stop 250. The absorber recesses 265 are configured to receive an absorber (not shown) that forms the point of contact and connection between the floating door stop 250 and door frame 150. The locator arms 280 and/or extensions 281 are adapted to mate with the door stop recess 170 of the door frame 150, and the width W is sufficiently small to allow for clearance and lateral movement of the floating door stop 250 with respect to the door stop recess 170 of the door frame 150.

Figure 7:
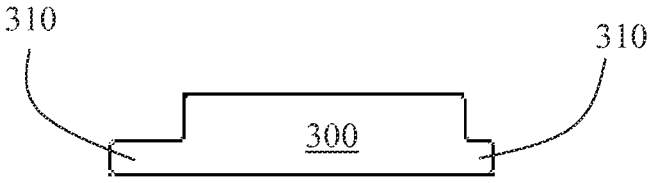
FIG. 7 is a schematic end view of a support plate.

FIG. 7 is a schematic end view of a support plate 300 that may comprise one or more protrusions 310. The support plate 300 and its associated protrusions 310 are configured to mate with the contours of the hardware recess 160 of the door frame 150. In certain embodiments, the trimless door frame assembly 100 may not include structural supports for hinges, strike plates, and other door hardware as with traditional door frames. The support plate 300 may be installed on the door frame 150 to provide hard mounting points for hinges, strike plates, or other door hardware. Similar to the flush mount plate 200, the support plate 300 may be used alone or in conjunction with the flush mount plate 200 to stack components in the hardware recess 160 during construction of a trimless door frame assembly 100.

FIGS. 8-11 are sectional end views of a hinge frame side 150*b* and strike plate frame side 150*c* with flush mount plates 200, floating door stops 250, support plates 300, and additional hardware as typically installed to a hinge side stud 151*b* and plate side stud 151*c*, respectively. The frame side 150*b*, 150*c* may be affixed or otherwise attached to a stud 151*b*, 151*c* with drywall screws 153 that pass through the flanges 156 and wall or drywall 600 into the studs 151*b*, 151*c*. The flanges 156 may overlap the wall or drywall 600 to varying degrees to adjust the amount of spacing between the rear side 155 of the frame side 150*b*, 150*c*. The spacing between the rear side 155 of the frame side 150*b*, 150*c* may be used to compensate for variations in the size or trueness of the wall opening. The frame side 150*b*, 150*c* may then be adjusted to be plumb with respect to the ground and adjacent frame sides 150*a-c*. In certain embodiments, the flanges may be left exposed, painted, anodized, or covered with mud, sanded, and painted to match the drywall to provide a smooth and clean appearance. In some embodiments, a decorative reveal 180 may be included in the frame side 150*b*, 150*c*.

A floating door stop 250 may be positioned along the length of each frame side 150*a-c* and more particularly is positioned within the door stop recess 170 on each frame side 150*a-c* and retained therein via locator arms 280. The floating door stop 250 may include a door silencer 260 positioned within silencer recess 255 on the strike face 251 of the door stop frame 252. The door silencer 260 may be formed of a gasket material, such as a rubber or other elastomeric material. One exemplary gasket material for the door silencer is a thermoplastic vulcanizate (TPV) material. The door silencer 260 acts to seal the door 500 (not shown) against the floating door stop 250 and silences the door 500 as it closes against the floating door stop 250. The locator arms 280 may interact with the projections 175 of the door stop recess 170 to allow a loose-fit between the floating door stop 250 and door stop recess 170. As shown, the locator arms 280 have clearance around their ends to allow the floating door stop 250 to move laterally relative to the door stop recess 170. In certain embodiments, the locator arms 280 may have different end configurations to allow for additional degrees of freedom. For example, as shown in FIGS. 8-11, the locator arms 280 allow for relative movement between the floating door stop 250 and door stop recess 170, and subsequently the frame side 150*b*, 150*c*, in the direction perpendicular to the strike face 251 of the floating door stop 250. However, the locator arms 280 have extensions 281 that restrict relative movement between the floating door stop 250 and door stop recess 170 in a direction parallel to the strike face 251 of the floating door stop 250.

In some embodiments, the locator arms 280 may not have the extensions 281 or otherwise be designed to allow for relative movement between the floating door stop 250 and door stop recess 170 in a direction parallel to the strike face 251 of the floating door stop 250. Certain embodiments of the floating door stop 250, locator arms 280, extensions 281, door stop recess 170, and/or projections 175 may be configured to allow for relative movement between the floating door stop 250 and door stop recess 170 in one, two, or three dimensions, including rotation about any given axis.

The floating door stop 250 may also include one or more absorbers 270 positioned within or proximate to the door stop frame 252 and more particularly within the absorber recesses 265 of the door stop frame 252. The absorbers 270 may be a spring or a component made from rubber, an elastomer, cellular material, a polymer, a thermoplastic vulcanizate, or any other material selected for its ability to deflect, compress, or elongate and regain its shape to absorb and distribute forces. The absorbers 270 function to stabilize the floating door stop 250 in an aligned position within door stop recess 170 of a frame side 150*a-c*. When the floating door stop 250 encounters a force, such as when a door is closed against the strike face 251 of the door stop frame 252, the floating door stop 250 will be laterally displaced relative to the door stop recess 170, which compresses the absorber 270 distal the strike face 251 into a projection 175 of the door stop recess 170 such that the absorber 270 absorbs the energy of the door closure instead of the surrounding wall. More specifically, the motion and/or displacement of the floating door stop 250 distributes the impact of a door closure or other applied force over a larger amount of time as the absorber 270 deflects and extends the range of motion of the floating door stop 250. The impact energy applied through the floating door stop 250 extends over a larger time with a correspondingly lower peak force. Also, the internal friction and deflection of the absorber 270, along with any frictional losses due to the movement of the floating door stop 250 relative to any other parts of the frame side 150*b*, 150*c* may absorb and dissipate impact energy. The resulting force transferred through a trimless door frame assembly 100 to the studs 151*b*, 151*c* and wall or drywall 600 has a much lower peak magnitude relative to solidly mounted door stops. These lower peak forces greatly reduce the chances of cracking or fatigue, particularly of the wall or drywall 600 at or around the frame sides 150*a-c* and/or drywall screws 153, even through repeated cycles of opening and closing the door. While the floating door stop is shown equipped with two absorbers 270, it is certainly contemplated to use a single absorber 270 or more than two absorbers 270.

Figure 9:
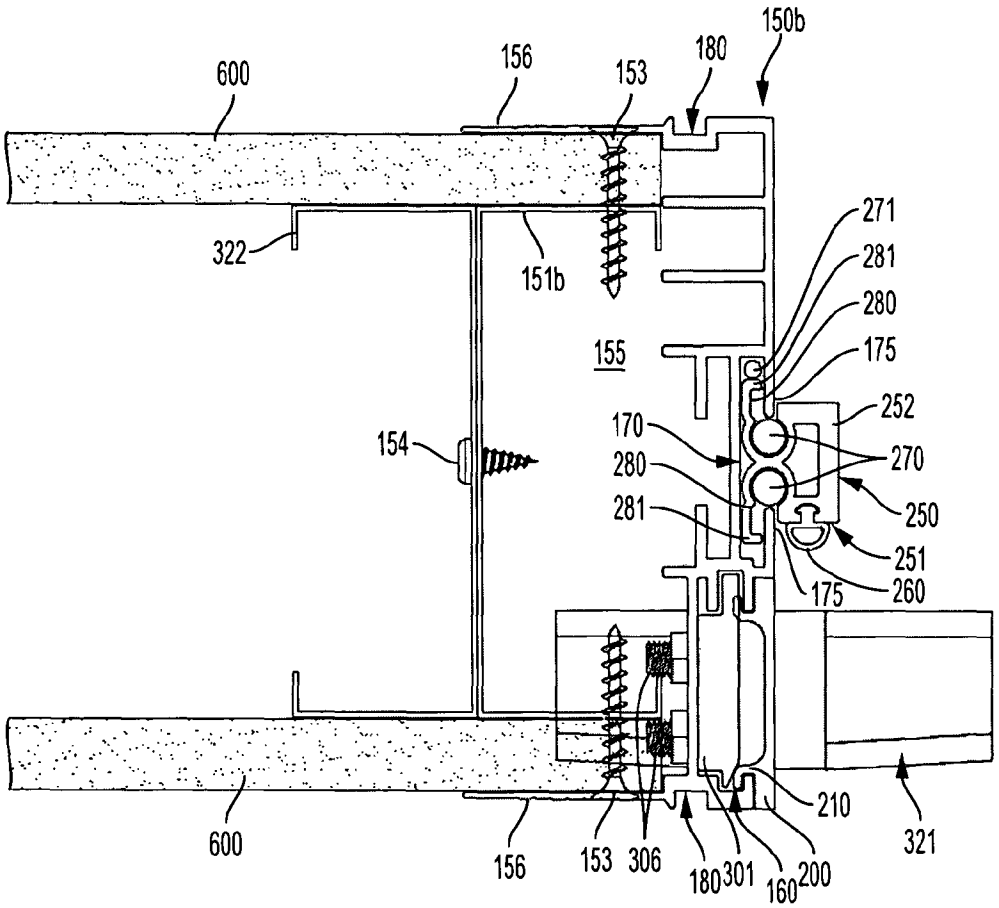
FIG. 9 is a sectional end view of a hinge side trimless door frame with a concealed hinge.
Figure 10:
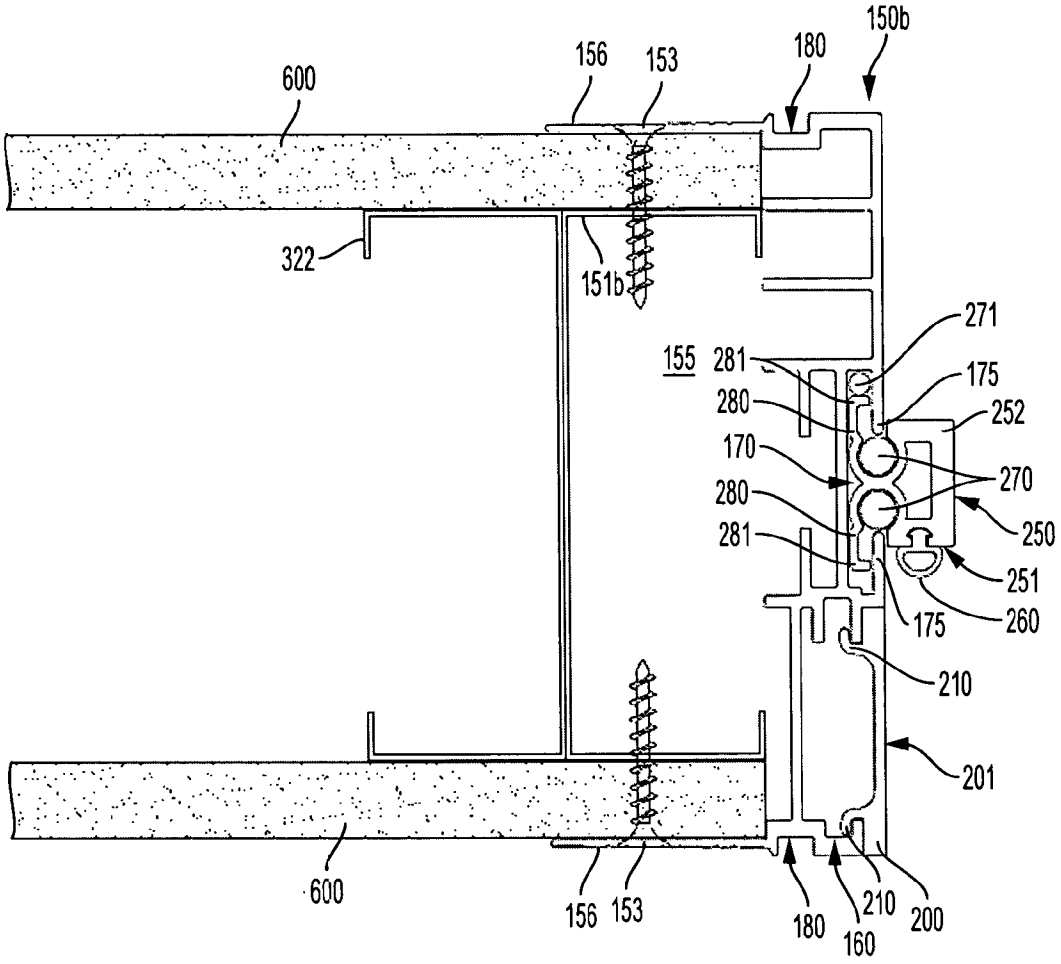
FIG. 10 is a sectional end view of a hinge side trimless door frame with a flush mount plate.
Figure 11:
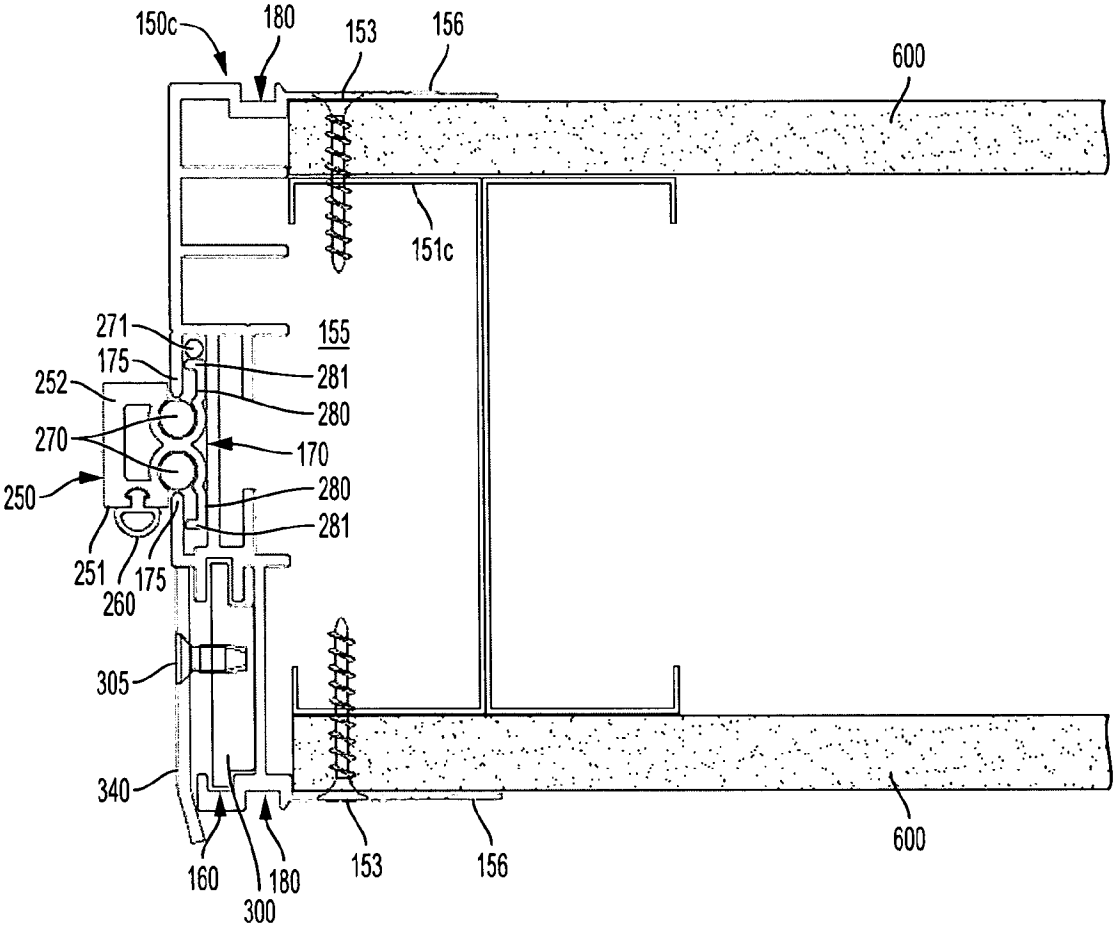
FIG. 11 is a sectional end view of a strike plate side trimless door frame with a strike plate.

The floating door stop 250 may include any number of modifications or alterations to suit a particular application. For example, as shown in FIGS. 9-11, an auxiliary absorber 271 may be included in the door stop recess 170 to support or otherwise cushion one or more of the locator arms 280 or extensions 281. As shown, the auxiliary absorber 271 is disposed between the locator arm 280 and the door stop recess 170 on the opposite side of the floating door stop 250 as the strike face 251. This auxiliary absorber 271 may be particularly beneficial for absorbing the forces associated with closing of a door. Furthermore, absorbers 270 and/or auxiliary absorbers 271 may be positioned in any orientation or relation between the floating door stop 250, locator arms 280, and or extensions 281 and the door stop recess 170, projections 175, and/or frame sides 150*a-c*.

In order to adjust or optimize the amount of force absorption for a particular application, the floating door stop 250 (with absorber(s) 270 and optional auxiliary absorbers 271) may take on different materials, geometries, or characteristics. For example, the absorbers 270 or auxiliary absorbers 271 may be hollow or solid, and may be made from any material that is suitable for its characteristics to compress, deflect, or elongate in response to an applied load over a large number of loading cycles. In some embodiments, the absorber 270 and/or auxiliary absorber 271 may be cast or otherwise molded in place within the absorber recesses 265 or between the floating door stop 250, locator arms 280, extensions 281, door stop recess 170, and/or projections 175. In certain embodiments, the absorbers 270 and/or auxiliary absorbers 271 may be asymmetrical so as to better adapt to differing levels of force applied in different directions. The absorber 270 and/or auxiliary absorber 271 may also be affixed or otherwise attached to the floating door stop 250, locator arms 280, extensions 281, door stop recess 170, and/or projections 175 by adhesives, directly molding the absorbers 270 and/or auxiliary absorbers 271 to a surface, or forming the absorbers 270 and/or auxiliary absorbers 271 in such a shape as to allow them to accept tensile loads between the floating door stop, locator arms, and/or extensions 281 and the door stop recess 170 and/or projections 175 in addition to compressive loads.

Figure 8:
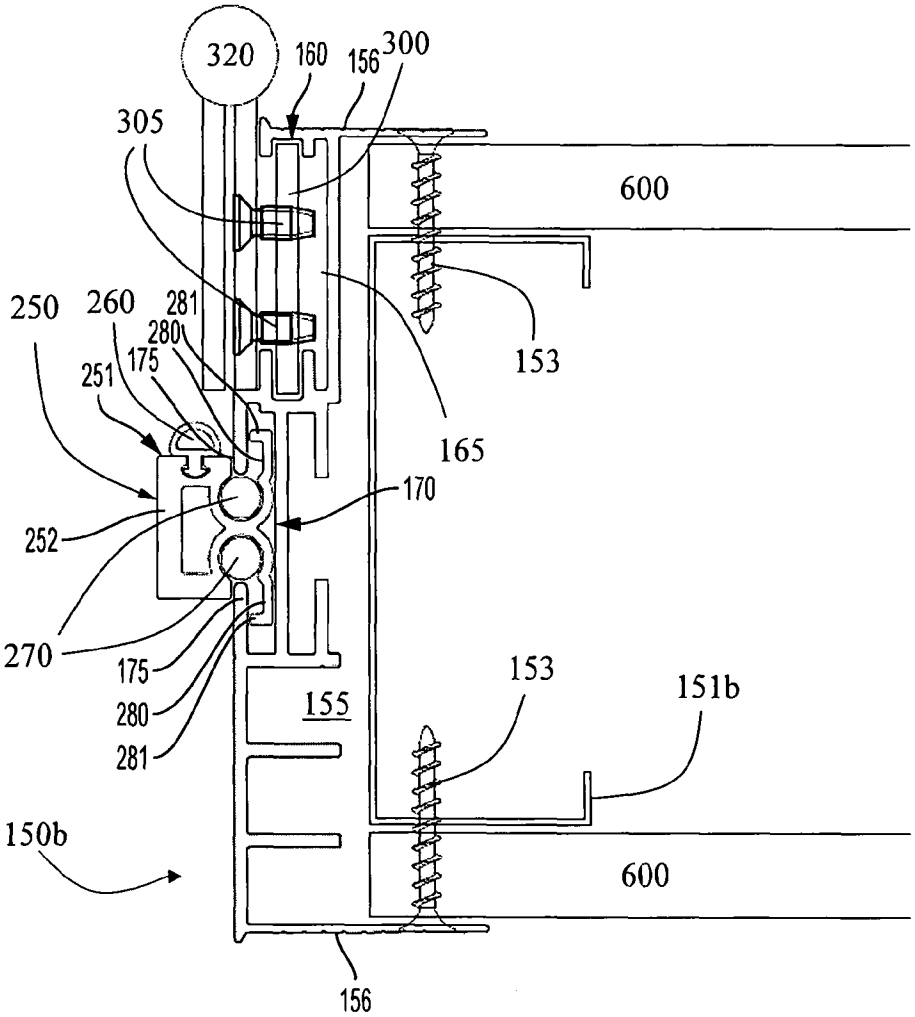
FIG. 8 is a sectional end view of a hinge side trimless door frame with a traditional hinge.

Referring to FIG. 8, a hinge frame side 150*b* may also include a hinge 320 coupled to a support plate 300. The support plate 300 is installed in the hardware recess 160 of the hinge frame side 150*b*. In certain embodiments, the support plate 300 may be slid along the length of the hinge frame side 150*b* to the appropriate location for mounting the hinge 320. As shown, the hinge 320 may be attached to a support plate 300 with standard fasteners 305. In certain embodiments, the fasteners 305 may be sufficiently long that they extend into the clearance gap 165.

FIGS. 9 and 10 are sectional views of a hinge frame side 150*b* adapted for use with concealed hinges 321 taken above and below the concealed hinge 321, respectively. Concealed hinges 321 may be substantially larger than traditional hinges, and may extend farther into the hinge frame side 150*b* such that they impinge upon the hinge side stud 151*b* and/or wall or drywall 600. Notches or other clearance apertures (not shown) must be cut into the hinge frame side 150*b*, hinge side stud 151*b*, and/or wall or drywall 600 to provide adequate clearance and space for the concealed hinge 321. In some embodiments, the weakening of the wall or drywall 600, hinge side stud 151*b*, and/or frame side 150*b* may require the use of a secondary hinge side stud 322 affixed to the primary hinge side stud 151*b* with an optional stud screw 154. The concealed hinge 321 may be affixed or otherwise attached to a concealed hinge support plate 301 with bolts 306 or other fasteners. The concealed hinge support plate 301 mates with hardware recess 160. The vertical positioning of the concealed hinge support plate 301, and consequently the concealed hinge 321, may be adjusted by stacking the concealed hinge support plate 301 in the hardware recess 160 with different lengths of flush mount plates 200. The flush mount plates 200, which may interact with the hardware recess 160 through arms 210, may provide vertical support to the concealed hinge support plate 301, and, as shown in FIG. 10, provide a flush, aesthetically pleasing surface when face surface 201 is coplanar with one or more other portions or features of the hinge frame side 150*b* and/or any other adjacent hardware. In certain embodiments, the flush mount plates 200 may be notched or cut to conform to the edge contours of a standard hinge 320, concealed hinge 321, or any other hardware that may impinge on the flush mount plates 200.

FIG. 11 is a sectional end view of a strike plate frame side 150*c* as installed with a strike plate 340. The strike plate 340 is attached to a support plate 300 by one or more fasteners 305. The support plate 300 is disposed within the hardware recess 160 of strike plate frame side 150*c*. The vertical location of the support plate 300, and the attached strike plate 340, may be adjusted by stacking the support plate 300 in the hardware recess 160 with differing lengths of flush mount plates 200 (not shown). The flush mount plates 200 may be notched or otherwise cut or shaped to fit the contours of the strike plate 340 or any other hardware that may be in the vicinity of the flush mount plates 200.

Figure 12C:
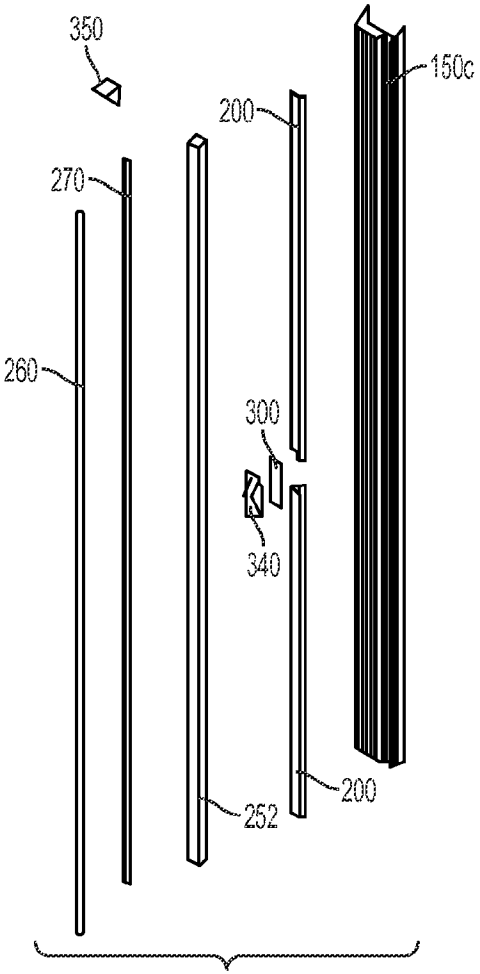
FIG. 12C is an assembly view of a plate side trimless door frame.
Figure 12B:
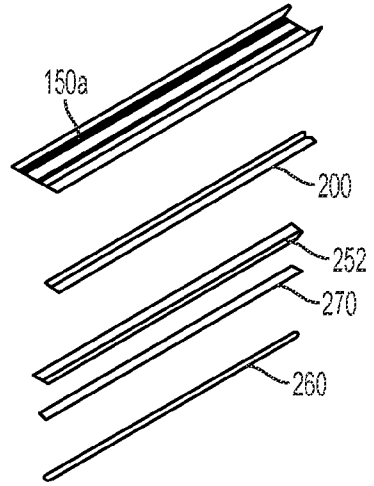
FIG. 12B is an assembly view of a top side trimless door frame.
Figure 12A:
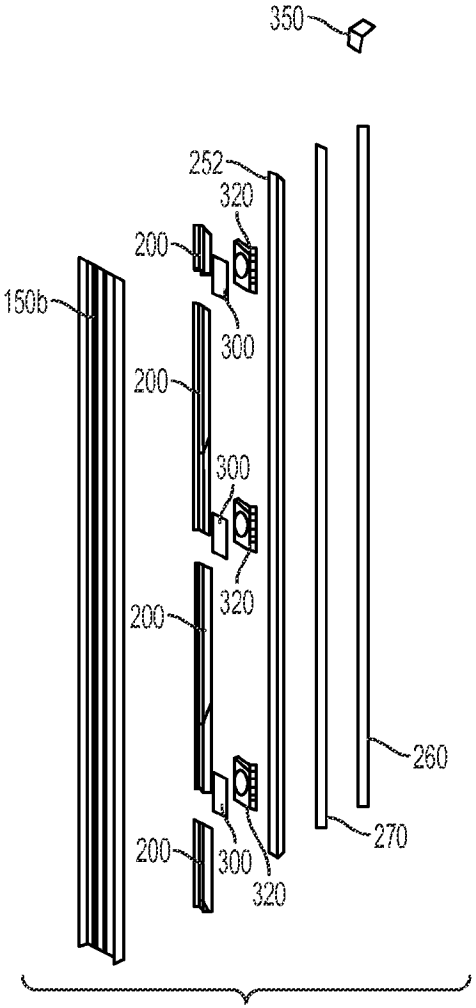
FIG. 12A is an assembly view of a hinge side trimless door frame.

FIGS. 12A-C are assembly views of exemplary embodiments of the hinge frame side 150*b*, top frame side 150*a*, and strike plate frame side 150*c*. The frame sides 150*a-c* may be provided with a series of flush mount plates 200 interspersed with one or more support plates 300. Each frame side 150*a-c* may also include a door stop frame 252 with a door silencer 260 and absorber 270. One exemplary method of installing the flush mount plates 200, support plates 300, door stop frames 252, door silencers 260, and/or absorbers 270 comprises sliding the individual parts into their respective recesses or channels of the frame side 150*a-c* by aligning the part at the end of a recess and simply feeding it through.

As shown in FIG. 12B, the flush mount plate 200 and door stop frame 252 (with door silencer 260 and/or absorber 270) may be the same length as the top frame side 150*c* so that only one component of each is required to span the length of the top of the door frame 150. However, the flush mount plate 200 and door stop frame 252 (with door silencer 260 and/or absorber 270) may also be provided in multiple sections or pieces to facilitate installation, or to interact with other components of the trimless door frame assembly 100. For example, the hinge frame side 150*b* may require one or more support plates 300 to provide mounting points for one or more hinges 320. The flush mount plates 200 and support plates 300 may be installed in series such that the flush mount plates 200 establish the vertical location and/or support for the support plates 300. The positioning of the support plates 300 may be adjusted or otherwise altered by cutting the flush mount plates 200 to length and stacking the flush mount plates 200 and support plates 300 in order in the hardware recess 160 of the hinge frame side 150*b*. The hinges 320 may then be affixed or otherwise attached to the support plates 300 in any vertical position as necessary for a particular application.

Similarly, the strike plate frame side 150*c* may include a strike plate 340 affixed or otherwise attached to a support plate 300. The flush mount plates 200 may be cut to length and stacked in the hardware recess 160 of the strike plate frame side 150*c* along with the support plate 300 to vertically locate the support plate 300 and strike plate 340. In certain embodiments, the flush mount plates 200 may be notched, cut, or otherwise shaped to conform to the peripheral contours of a hinge 320, strike plate 340, or any other hardware that may be in contact with the flush mount plates 200.

Once the required components have been installed into individual frame sides 150*a-c*, the frame sides 150*a-c* may be connected with angle brackets 350 to form the door frame 150. The angle brackets 350 may be installed into assembly recesses 152 to connect the top frame side 150*a* with the hinge frame side 150*b* and strike plate frame side 150*c* on either side, respectively.

To further describe the operation and interaction of the flush mount plate 200, support plate 300, hinges 320, and/or strike plate 340, an exemplary installation method of strike plate frame side 150*c* is described. A first flush mount plate 200 is first inserted longitudinally into the hardware recess 160 (not shown) and slid along strike plate frame side 150*c* until the bottom of the flush mount plate 200 rests against the floor. As shown in FIG. 12C, the upper edge of the flush mount plate 200 towards the bottom of the figure may be notched such that it conforms to the strike plate 340. This notch, and others, would typically be made prior to taking the strike plate frame side 150*c* to the installation location, but they may also be made on-site. In other words, the flush mount plate 200 pieces are typically, but do not have to be, pre-cut. Next, a support plate 300 is inserted longitudinally into the hardware recess 160 and slid along the strike plate frame side 150*c* until it abuts the first flush mount plate 200, which prevents further translation of the support plate 300 within hardware recess 160 and locks support plate 300 in position. This position is where the strike plate 340 will be located. A second flush mount plate 200 is then inserted into hardware recess 160 and slide along strike plate frame side 150*c* as described above until it abuts the support plate 300. The strike plate 340 can then be secured (e.g., screwed) into the support plate 300. A similar assembly method is performed for the hinge frame side 150*b*, although this side may involve the installation of more flush mount plates 200 and support plates 300 depending on the number of hinges 320 used. The assembly of the top frame side 150*a* may be simpler, as there may not be hinges 320 or strike plates 340, and only a single flush mount plate 200 having substantially the same length as the top frame side 150*a* need be inserted into hardware recess 160. In much the same way, the floating door stop 250 may be installed into the frame sides 150*a-c* by aligning the floating door stop 250 with the end of the door stop recess 170. The floating door stop 250 may then be slid along the door stop recess 170 until it is fully installed within the frame side 150*a-c*.

Figure 13B:
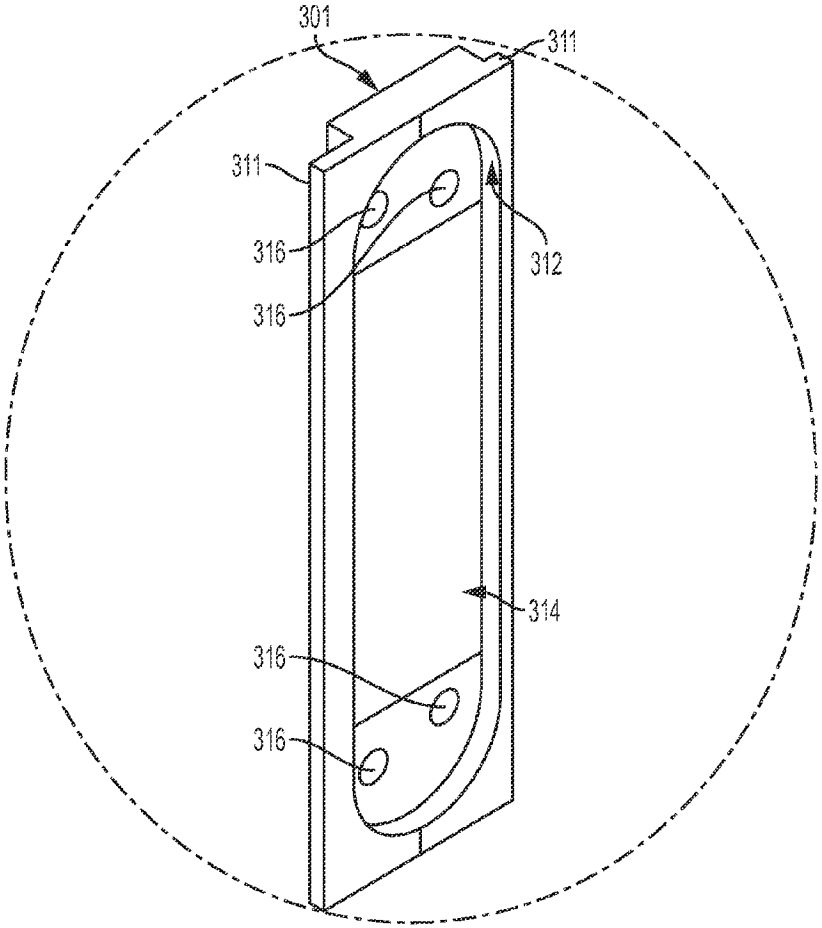
FIG. 13B is a detail perspective view of a support plate for a concealed hinge.
Figure 13A:
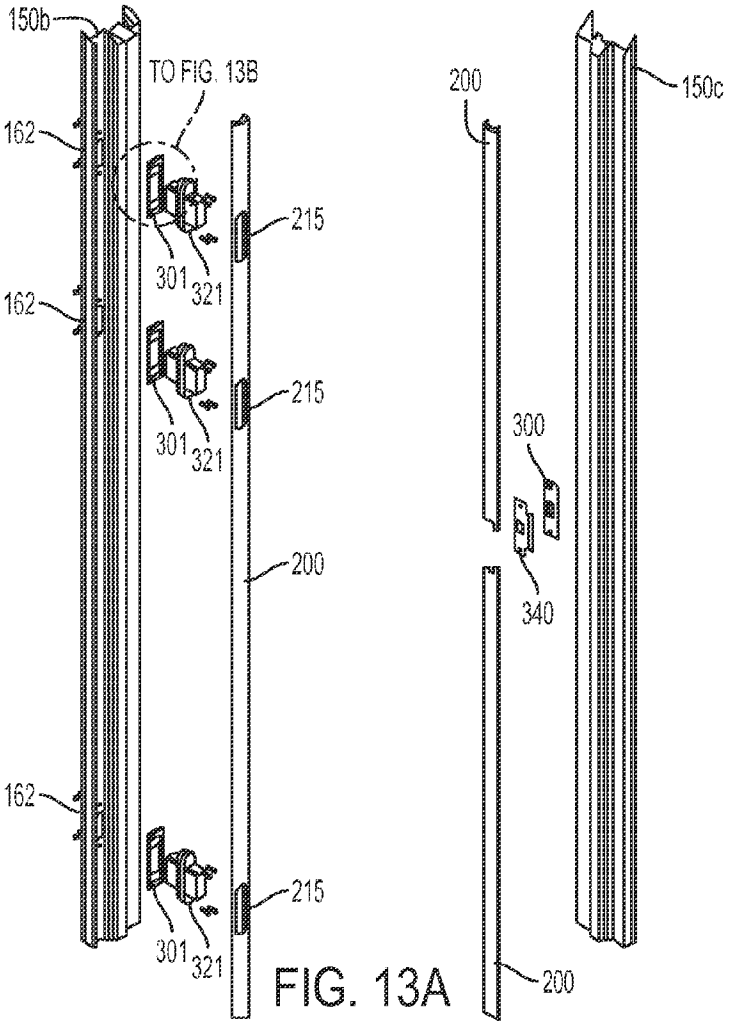
FIG. 13A is an assembly view of a trimless door frame with concealed hinges.

FIG. 13A is an assembly view of a hinge frame side 150*b* and strike plate frame side 150*c* with concealed hinges 321. The assembly of the strike plate frame side 150*c* may be similar to that described above, with a strike plate 340 mounted to a support plate 300, which is located by flush mount plates 200. The assembly of hinge frame side 150*b* may be altered or changed to support the use of concealed hinges 321 that are considerably larger and bulkier than traditional hinges. To accommodate concealed hinges 321, the hinge frame side 150*b* may include hardware apertures 162. The concealed hinge support plates 301, as shown in FIG. 13B, may include protrusions 311 for aligning and/or locating the concealed hinge support plate 301 in the hinge frame side 150*b*, a cavity 312, hinge aperture 314, and fastener holes 316. The cavity 312 and hinge aperture 314 may be configured to accept the concealed hinge 321 so that it may be affixed or otherwise mounted to the concealed hinge support plate 301 via fastener holes 316. Similarly, flush mount plate 200 may also include apertures 215 to provide clearance for the concealed hinges 321. As shown, the flush mount plate 200 may be a single piece or may be separate pieces as described above. A single piece flush mount plate 200 may be installed by sliding it into the hardware recess 160, before or after the installation of the concealed hinge support plates 301.

Referring to FIGS. 12A-C and 13A, the trimless door frame assembly 100 may take on a number of variations or alternative embodiments. For example, trimless door frame assemblies 100 may be fully or partially assembled in a factory or other production facility, including any necessary trimming or shaping of the flush mount plates 200 or any other parts, and installed on site. Alternatively, trimless door frames assemblies 100 may be provided as kits, as individual components cut to length, individual components provided in stock lengths and cut on site, or as bulk lengths of stock material to be cut into individual components on site. In any embodiment, features such as, but not limited to, hardware apertures 162, apertures 215, length, notches, or the like may be cut or formed either in a manufacturing facility or on site during door installation. Furthermore, components such as the flush mount plates 200, door stop frames 252, door silencers 260, absorbers 270, support plates 300, 301 or the like may be installed by snapping them into place, retaining them with fasteners or adhesives, or sliding them into the applicable recesses as described above. Certain embodiments of the trimless door frame assembly 100 may include the floating door stop 250 and its associated hardware on only the top frame side 150*a*, hinge frame side 150*b*, strike plate frame side 150*c*, or any combination thereof.

Figure 15:
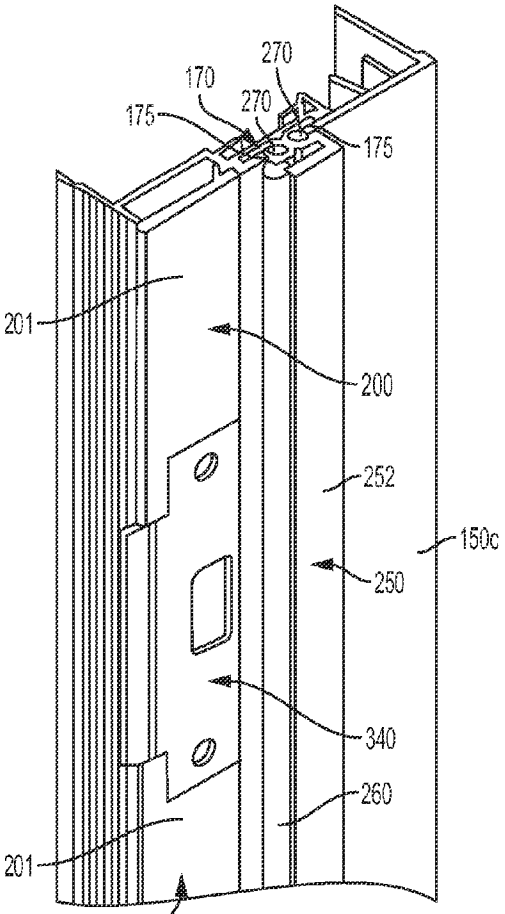
FIG. 15 is a perspective view of a plate side trimless door frame assembly.
Figure 14:
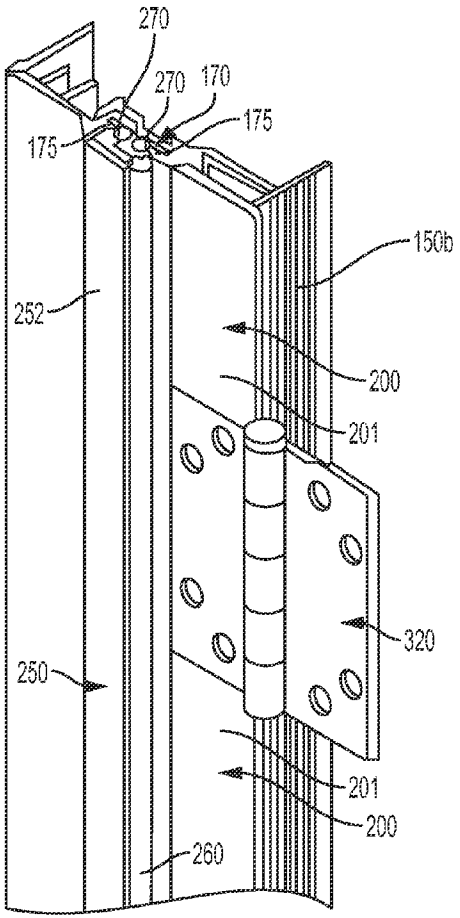
FIG. 14 is a perspective view of a hinge side trimless door frame assembly.

FIGS. 14 and 15 are perspective views of the hinge frame side 150*b* and strike plate frame side 150*c*. The frame sides 150*b*, 150*c* include a floating door stop 250 with door stop frame 252, door silencer 260, and absorbers 270. The hinge frame side 150*b* has a hinge 320 disposed on mounting plate 300 and between two flush mount plates 200. Similarly, the strike plate frame side 150*c* has a strike plate 340 installed on mounting plate 300 and between two flush mount plates 200. As shown, the flush mount plates 200 have a face surface 201 that is coplanar with the hinge 320 and/or strike plate 340. The flush mount plates 200 may also be notched or otherwise shaped to mate with the contours of the hinge and/or strike plate 340 to provide a relatively flat visible surface.

FIG. 16 is a perspective view of the trimless door frame assembly 100 as assembled from a top frame side 150*a*, hinge frame side 150*b*, and strike plate frame side 150*c*. The flush mount plates 200 and hinges 320 are visible on the hinge frame side 150*b*. The frame sides 150*a-c* have been assembled by inserting angle brackets 350 into the assembly recesses 152 (not shown). The frame sides 150*a-c* may be assembled into a trimless door frame assembly 100 in a wall or wall frame, or they may be assembled and then installed into a wall or wall frame.

Any of the above described components, parts, or embodiments may take on a range of shapes, sizes, or materials as necessary for a particular application of the described invention. The components, parts, or mechanisms of the described invention may be made of any materials selected for the suitability in use, cost, or ease of manufacturing. Materials including, but not limited to aluminum, stainless steel, fiber reinforced plastics, rubber, elastomers, carbon fiber, composites, polycarbonate, polypropylene, other metallic materials, or other polymers may be used to form any of the above described components.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A door frame assembly comprising:

a. a door frame comprising at least one frame side, wherein the at least one frame side comprises a first flange and a second flange spaced a distance from the first flange, wherein the distance defines a width of the at least one frame side, wherein the at least one frame side comprises an outer surface extending in a direction across the width of the at least one frame side, and wherein the at least one frame side further comprises a length and a cross-sectional profile having at least one door stop recess; and b. a door stop comprising:

(i) a door stop frame positioned at least partially within the at least one door stop recess, wherein a portion of the door stop frame extends beyond the outer surface of the at least one frame side while positioned at least partially within the at least one door stop recess; and (ii) at least one absorber comprising a compressible material disposed at least partially within the at least one door stop recess, wherein the door stop is translatable relative to the at least one frame side and in a direction parallel to the width of the at least one frame side in response to a force.

2. The door frame assembly of claim 1, wherein the door stop is translatable within the at least one door stop recess in a direction perpendicular to the length of the at least one frame side.

3. The door frame assembly of claim 1, wherein:

the door stop frame further comprises at least one locator arm and at least one absorber recess;

the at least one frame side comprises at least one projection that at least partially defines the at least one door stop recess;

the at least one absorber is disposed at least partially within the at least one absorber recess and contacts the at least one projection; and the at least one locator arm is disposed at least partially within the at least one door stop recess to limit translation of the door stop in response to the force.

4. The door frame assembly of claim 3, wherein the at least one absorber compresses against the at least one projection when the door stop translates in response to the force.

5. The door frame assembly of claim 3, further comprising an auxiliary absorber disposed within the at least one door stop recess proximate the at least one locator arm.

6. The door frame assembly of claim 3, wherein:

the at least one absorber recess comprises two absorber recesses;

the at least one locator arm comprises two locator arms;

the at least one absorber comprises two absorbers; and the at least one projection comprises two projections, wherein each of the two absorbers is disposed at least partially within one of the two absorber recesses such that each of the two absorbers contacts one of the two projections in response to the force.

7. The door frame assembly of claim 6, wherein the two absorbers are symmetrical.

8. The door frame assembly of claim 1, wherein the compressible material comprises a polymeric material or a spring.

9. The door frame assembly of claim 1, further comprising a door silencer disposed on a strike face of the door stop frame.

10. The door frame assembly of claim 9, wherein the door stop frame comprises a silencer recess formed in the strike face and wherein the door silencer is positioned at least partially within the silencer recess.

11. An installation comprising (i) the door frame assembly of claim 1 provided at least partially around a perimeter of a door opening in a wall, (ii) a door mounted to the door frame assembly and spanning the door opening in the wall when in a closed position, and (iii) a covering provided over at least a portion of the at least one frame side, wherein the door frame assembly is not visible on the wall when the door is in the closed position and wherein the force comprises the door hitting the door stop upon closing.

12. A door frame assembly comprising:

a strike plate frame side having a length and a width, wherein the length is greater than the width;

a hinge frame side having a length and a width, wherein the length is greater than the width;

a top frame side having a length and a width, wherein the length is greater than the width, wherein the strike plate frame side, the hinge frame side, and the top frame side define a door opening; and at least one door stop comprising a door stop frame and at least one absorber, wherein the at least one door stop is mounted on at least one of the strike plate frame side, the hinge frame side, and the top frame side such that the at least one absorber is disposed between the door stop frame and the at least one of the strike plate frame side, the hinge frame side, and the top frame side, wherein the at least one door stop is translatable within a door stop recess defined by, and with respect to, the at least one of the strike plate frame side, the hinge frame side, and the top frame side and in a direction parallel to the width of the at least one of the strike plate frame side, the hinge frame side, and the top frame side in response to a force, and wherein a portion of the door stop frame extends into the door opening beyond the least one of the strike plate frame side, the hinge frame side, and the top frame side to which the door stop frame is mounted.

13. The door frame assembly of claim 12, wherein the hinge frame side comprises a hardware recess and wherein the door frame assembly further comprises at least one support plate and at least one flush mount plate positioned abuttingly within the hardware recess of the hinge frame side, wherein a hinge is mounted on the at least one support plate on the hinge frame side.

14. The door frame assembly of claim 12, wherein the strike plate frame side comprises a hardware recess and wherein the door frame assembly further comprises at least one support plate and at least one flush mount plate positioned abuttingly within the hardware recess of the strike plate frame side, wherein a strike plate is mounted on the at least one support plate on the strike plate frame side.

15. The door frame assembly of claim 12, wherein each of the strike plate frame side, the hinge frame side, and the top frame side comprises a cross-sectional profile and wherein the cross-sectional profiles of the strike plate frame side, the hinge frame side, and the top frame side are identical.

16. The door frame assembly of claim 12, wherein:

the door stop frame comprises at least one absorber recess and a silencer recess, wherein a compressible door silencer is positioned at least partially within the silencer recess;

the door stop recess is at least partially defined by at least one projection; and the at least one absorber is disposed at least partially within the at least one absorber recess and compresses against the at least one projection when the door stop frame translates in response to the force.

17. The door frame assembly of claim 16, wherein the door stop frame further comprises at least one locator arm, wherein the at least one locator arm is disposed at least partially within the at least one door stop recess to limit translation of the door stop frame in response to the force.

18. The door frame assembly of claim 16, wherein:

the at least one absorber recess comprises two absorber recesses;

the at least one absorber comprises two absorbers;

the at least one projection comprises two projections; and each of the two absorbers is disposed at least partially within one of the two absorber recesses such that each of the two absorbers contacts one of the two projections in response to the force.

19. A door frame assembly comprising:

a. a door frame comprising at least one frame side, wherein the at least one frame side comprises a first flange and a second flange spaced a distance from the first flange, wherein the distance defines a width of the at least one frame side, wherein the at least one frame side further comprises a length and a cross-sectional profile having at least one door stop recess, and wherein the at least one frame side comprises at least one projection that at least partially defines the at least one door stop recess; and b. a door stop comprising:

(i) a door stop frame positioned at least partially within the at least one door stop recess, wherein the door stop frame comprises at least one locator arm and at least one absorber recess; and (ii) at least one absorber comprising a compressible material, wherein the at least one absorber is disposed at least partially within the at least one absorber recess so as to be located at least partially within the at least one door stop recess and in contact with the at least one projection, wherein the door stop is translatable relative to the at least one frame side and in a direction parallel to the width of the at least one frame side in response to a force, and wherein the at least one locator arm is disposed at least partially within the at least one door stop recess to limit translation of the door stop in response to the force.

* * * * *